US012247736B2

(12) United States Patent
Turner

(10) Patent No.: US 12,247,736 B2
(45) Date of Patent: Mar. 11, 2025

(54) COMPACT REFRACTORY LINED THERMAL OXIDIZER

(71) Applicant: Black Lambo LLC, Roswell, GA (US)

(72) Inventor: Benjamin Turner, Roswell, GA (US)

(73) Assignee: Black Lambo LLC, Roswell, GA (US)

( * ) Notice: Subject to any disclaimer, the term of this patent is extended or adjusted under 35 U.S.C. 154(b) by 0 days.

(21) Appl. No.: 18/733,147

(22) Filed: Jun. 4, 2024

(65) Prior Publication Data

US 2024/0426480 A1 Dec. 26, 2024

Related U.S. Application Data

(60) Provisional application No. 63/522,951, filed on Jun. 23, 2023.

(51) Int. Cl.
*F23M 5/00* (2006.01)
*F23L 7/00* (2006.01)

(52) U.S. Cl.
CPC ..... *F23M 5/00* (2013.01); *F23L 7/005* (2013.01); *F23M 2900/05004* (2013.01)

(58) Field of Classification Search
None
See application file for complete search history.

(56) References Cited

U.S. PATENT DOCUMENTS

| | | | |
|---|---|---|---|
| 4,441,880 | A | 4/1984 | Pownall et al. |
| 2011/0067611 | A1 | 3/2011 | Amadesi |
| 2019/0316773 | A1 | 10/2019 | Evans et al. |
| 2020/0200079 | A1 | 6/2020 | Lineton |

FOREIGN PATENT DOCUMENTS

| | | | | |
|---|---|---|---|---|
| DE | 3725469 | A1 * | 2/1989 | |
| DE | 19535638 | A1 * | 2/1997 | ..... F22B 31/045 |
| JP | 2003302029 | A * | 10/2003 | |
| WO | 2021030088 | A1 | 2/2021 | |

OTHER PUBLICATIONS

International Search Report and Written Opinion dated Nov. 5, 2024 cited in Application No. PCT/US24/32526, 19 pgs.

* cited by examiner

*Primary Examiner* — Jason Lau
(74) *Attorney, Agent, or Firm* — BEKIARES ELIEZER LLP

(57) ABSTRACT

A compact thermal oxidizer is disclosed, comprising a combustion chamber and a series of ducts including a first duct, a second duct, a third duct, and a fourth duct. The combustion chamber is connected to the first duct, which in turn directs fluid flow into the second duct in an antiparallel direction to the combustion chamber. The second duct is linked to the third duct, which guides the fluid flow into the fourth duct, in aa direction antiparallel to the flow in the second duct and parallel to the flow in the combustion chamber. A refractory lining is disposed on the interior surfaces of the combustion chamber, first duct, and second duct.

20 Claims, 6 Drawing Sheets

COMPACT REFRACTORY LINED THERMAL OXIDIZER

RELATED APPLICATION

Under provisions of 35 U.S.C. § 119 (e), the Applicant claims benefit of U.S. Provisional Application No. 63/522,951 filed on Jun. 23, 2023, and having inventors in common, which is incorporated herein by reference in its entirety.

It is intended that the referenced application may be applicable to the concepts and embodiments disclosed herein, even if such concepts and embodiments are disclosed in the referenced application with different limitations and configurations and described using different examples and terminology.

FIELD OF THE TECHNOLOGY

Consistent with embodiments of the present disclosure, the present disclosure generally relates to thermal processing systems. Specifically, the present disclosure relates to compact thermal oxidizers comprising combustion chambers and multiple ducts in fluid communication.

DESCRIPTION OF THE RELATED ART

Traditional thermal oxidizers have typically consisted of a single combustion chamber where the oxidation of pollutants takes place. The combustion chamber is designed to reach high temperatures to facilitate the oxidation process effectively. However, the design of these conventional thermal oxidizers often results in inefficiencies due to heat loss and incomplete combustion of pollutants. Additionally, the single-chamber configuration limits the control over the flow of gases and the residence time within the system, potentially leading to suboptimal treatment of pollutants.

In some prior art systems, attempts have been made to improve the efficiency of thermal oxidizers by incorporating multiple chambers or stages to enhance the oxidation process. These multi-chamber systems aim to increase the residence time of gases within the system, allowing for more complete combustion of pollutants. However, these designs can be complex, bulky, and costly to manufacture and maintain. The interconnection between chambers may also introduce challenges in controlling the flow of gases and maintaining consistent operating conditions throughout the system.

Combustion apparatuses are necessary components of many industrial and pharmaceutical systems. Heat provided by these systems can be used for incineration, dehydration, evaporation, energy production and/or other processes. In particular, combustion apparatuses play a role in the production of vaccines.

Some situations involve the handling and processing of fluids with high thermal energy. For instance, industrial processes may produce hot gases or vapors that require management and redirection. Conventional strategies often involve directing these hot fluids through a series of ducts to manage their flow and temperature. However, this approach may face difficulties due to the intense heat of the fluids, which can cause damage to the ducts and associated equipment. In addition, the direction of fluid flow may be challenging to control, leading to inefficiencies in the process.

Moreover, the materials used in the construction of these ducts and chambers may not be able to withstand the high temperatures. For instance, common duct materials like steel or iron may warp or melt under extreme heat, leading to system failure. Hence, the selection of suitable materials for the construction of these ducts and chambers presents a significant challenge.

Furthermore, the integration of measurement instruments within these high-temperature environments can pose additional difficulties. For example, integrating these instruments within the ducts or chambers may expose them to extreme temperatures, potentially impacting their functionality and lifespan.

Additionally, the utilization of thermal energy from these hot fluids is another concern. Conventional strategies often fail to capture and utilize this thermal energy effectively, leading to energy wastage.

Traditional thermal oxidizers may be generally configured to have a single, straight duct, acting as a combustion chamber and mixing chamber, with a single 90° bend at an outlet of the duct to redirect exhaust flows. However, typical designs consume a large amount of floor space. If the footprint of the device was reduced, there would be more floor space available for other components, or more iterations of the device, all of which lead to a desirable increase in overall plant efficiency. One option to address this issue is to employ space saving measures. However, this endeavor brings about substantial challenges in designing a suitable configuration of the thermal oxidizer. For example, one option to save space is to shorten the combustion chamber and mixing chamber.

Typically, shortening the overall length of an oxidizer may lead to a dramatic reduction in efficiency. Combustion is an explosive reaction and requires space for expansion. Reducing the length of an oxidizer increases the amount of fuel that can escape the combustion areas without combusting, leading to lower combustion efficiency, which corresponds to increased fuel costs relative to a fixed output. To maximize efficiency, the burner output must be reduced to accommodate the smaller combustion chamber, which leads to a lower net heat output of the oxidizer. In addition, the escape of uncombusted fuel can pose far greater pollution concerns than the combusted counterparts.

In conclusion, the management of high-temperature fluids in industrial processes presents several challenges related to heat energy management, materials selection, fluid flow direction, system integration, and process monitoring.

SUMMARY

Consistent with embodiments of the present disclosure, a compact thermal oxidizer may be comprised of a combustion chamber and a plurality of ducts.

In some aspects, the techniques described herein relate to a compact thermal oxidizer, including: a combustion chamber, and a plurality of ducts including a first duct, a second duct, a third duct, and a fourth duct. The combustion chamber is in fluid communication with an inlet of the first duct, and the first duct is in fluid communication with the second duct, such that the first duct is configured to direct a fluid flow exiting the combustion chamber into an inlet of the second duct. A direction of the fluid flow in the second duct is antiparallel to a direction of the fluid flow in the combustion chamber. The second duct is in fluid communication with the third duct, such that the third duct is configured to direct the fluid flow exiting the second duct into an inlet of the fourth duct, and a direction of the fluid flow in the fourth duct is antiparallel to the direction of the fluid flow in the second duct and parallel to the direction of the fluid flow in the combustion chamber. A refractory lining is disposed on interior surfaces of at least the combustion chamber, the first duct, and the second duct.

In some aspects, the techniques described herein relate to a system including a dehydrator configured to receive an input of thermal energy, and to output a vapor as a product of operation. The system may further include a burner configured to receive, as inputs, a flow of combustion air and a flow of fuel, and to produce, as an output, a fluid flow including combustion reactants. The system may include a compact thermal oxidizer having a combustion chamber in fluid communication with the burner, and a plurality of ducts, including a first duct, a second duct, a third duct and a fourth duct. The combustion chamber is configured to receive the fluid flow of combustion reactants and to facilitate combustion of the combustion reactants to form combustion products. The first duct includes an inlet in fluid communication with an outlet of the combustion chamber, and may be configured to direct flow of the combustion products exiting the combustion chamber into an inlet of the second duct, such that a direction of the fluid flow of combustion products in the second duct is antiparallel to a direction of the fluid flow of the combustion products in the combustion chamber. The third duct, includes an inlet in fluid communication with an outlet of the second duct and may be configured to direct the fluid flow of combustion products from the outlet of the second duct into an inlet of the fourth duct, such that a direction of the fluid flow of combustion products in the fourth duct is antiparallel to the direction of a fluid flow in the second duct and parallel to the direction of the fluid flow in the combustion chamber. The fourth duct may be configured to exhaust the fluid flow of combustion products into the dehydrator. The exhausted fluid flow has a significantly higher thermal energy, relative to a surrounding environment. A refractory lining substantially coats interior surfaces of at least the combustion chamber, the first duct, and the second duct. A vapor transport system is in fluid communication with the dehydrator, the vapor transport system being configured to transport the vapor output by the dehydrator to the compact thermal oxidizer to undergo combustion with the combustion reactants in at least one of the combustion chamber, the first duct, and the second duct.

In some aspects, the techniques described herein relate to a compact thermal oxidizer, including: a burner configured to intake a flow of combustion air and a flow of fuel, and output a fluid flow of combustion reactants. A fan assembly is configured to drive the flow of combustion air to the burner. A combustion chamber is configured to receive the fluid flow of combustion reactants from the burner and to facilitate combustion of the combustion reactants to form combustion products. The thermal oxidizer includes a plurality of ducts. A first duct has an inlet in fluid communication with the combustion chamber and includes a generally U-shaped bend. The first duct is configured to receive a fluid flow of the combustion product from the combustion chamber. A second duct has an inlet in fluid communication with an outlet of the first duct, the second duct being configured to receive the fluid flow from the first duct such that a direction of fluid flow in the second duct is antiparallel to a direction of fluid flow of the combustion products in the combustion chamber. A third duct has an inlet in fluid communication with the second duct and includes a generally U-shaped bend. The third duct is configured to receive the fluid flow of the combustion product from the second duct. A fourth duct has an inlet in fluid communication with an outlet of the third duct. The fourth duct is configured to receive the fluid flow from the third duct such that a direction of fluid flow in the fourth duct is antiparallel to the direction of fluid flow in the second duct and parallel to the direction of fluid flow in the combustion chamber. The fourth duct provides an exit from the compact thermal oxidizer for the fluid flow. The compact thermal oxidizer includes a housing configured surround the combustion chamber and at least a portion of the plurality of ducts, the housing including a housing inlet port into which the flow of combustion air enters, and a housing outlet port out of which the flow of combustion air exits. Prior to intake of the flow of combustion air at the burner, the flow of combustion air within the housing is heated via waste heat escaping the plurality of ducts. A refractory lining is disposed on interior surfaces of at least the combustion chamber, the first duct, and the second duct.

In an embodiment, a compact thermal oxidizer is provided. The compact thermal oxidizer may comprise: a combustion chamber; and a plurality of ducts including a first duct, a second duct, a third duct, and a fourth duct, wherein the combustion chamber is fluidly connected to an inlet of the first duct, and the first duct directs a fluid flow exiting the combustion chamber into an inlet of the second duct, such that a direction of the fluid flow in the second duct is antiparallel to a direction of the fluid flow in the combustion chamber, the third duct, being fluidly connected to the second duct, directs the fluid flow from an outlet of the second duct into an inlet of the fourth duct, such that a direction of the fluid flow in the fourth duct is antiparallel to a direction of the fluid flow in the second duct and parallel to the direction of the fluid flow in the combustion chamber, and at least the combustion chamber, the first duct, and the second duct have a refractory lining.

In another embodiment, a system is provided. The system may include a dehydrator, requiring at least an input of thermal energy to operate, and outputting at least a vapor as a product of operation; a vapor transport system; a burner; and a compact thermal oxidizer, comprising: a combustion chamber; and a plurality of ducts, including a first duct, a second duct, a third duct and a fourth duct, wherein the burner, being fluidly connected to the combustion chamber intakes at least a flow of combustion air and a flow of fuel and outputs at least a fluid flow of combustion reactants into the combustion chamber where the combustion reactants are combusted to form combustion products, the combustion chamber is fluidly connected to the inlet of the first duct, and the first duct directs the fluid flow of combustion products exiting the combustion chamber into an inlet of the second duct, such that a direction of the fluid flow of combustion products in the second duct is antiparallel to a direction of the fluid flow of the combustion products in the combustion chamber, the third duct, being fluidly connected to the second duct, is configured to direct the fluid flow of combustion products from an outlet of the second duct into an inlet of the fourth duct of the plurality of ducts, such that a direction of the fluid flow of combustion products in the fourth duct is antiparallel to the direction of a fluid flow in the second duct and parallel to the direction of the fluid flow in the combustion chamber, the fourth duct provides fluid communication out of the compact thermal oxidizer and exhausts the fluid flow of combustion products, having a significant thermal energy relative to the surroundings, into a dehydrator; the dehydrator outputs a vapor into the fluid transport system, which transports the vapor to the combustion chamber of the compact thermal oxidizer, where the vapor is incinerated in at least one of the combustion chamber, the first duct, and the second duct; and at least the combustion chamber, the first duct, and the second duct have a refractory lining.

In still another embodiment, a compact thermal oxidizer is provided. The compact thermal oxidizer may comprise: a burner; a fan assembly; a plurality of ducts, including a first duct, a second duct, a third duct and a fourth duct; a combustion chamber; and a housing, wherein the fan assembly supplies a flow combustion air to the burner; the burner, being fluidly connected to the combustion chamber, intakes at least the flow of combustion air and a flow of fuel and outputs at least a fluid flow of combustion reactants into the combustion chamber where the combustion reactants are combusted to form combustion products; the combustion chamber is fluidly connected to an inlet of the first duct, and the first duct directs the fluid flow of combustion products exiting the combustion chamber into an inlet of the second duct, such that a direction of the fluid flow of combustion products in the second duct is antiparallel to a direction of the fluid flow of the combustion products in the combustion chamber; the third duct, being fluidly connected to the second duct, directs the fluid flow of combustion products from an outlet of the second duct into an inlet of the fourth duct, such that a direction of the fluid flow of combustion products in the fourth duct is antiparallel to the direction of the fluid flow in the second duct and parallel to the direction of the fluid flow in the combustion chamber; and, the fourth duct provides fluid communication out of the compact thermal oxidizer; the housing contains the combustion chamber and the plurality of ducts, and has a housing inlet port, into which a flow of combustion air enters, and a housing outlet port, out of which the flow of combustion air exits, wherein the flow of combustion air is driven by the fan assembly, prior to the flow of combustion air arriving at the burner, and the combustion air is heated within the housing via waste heat escaping the plurality of ducts; and, at least the combustion chamber, the first duct, and the second duct have a refractory lining.

In another embodiment, a compact refractory lined thermal oxidizer is provided. The compact refractory lined thermal oxidizer may be compact and may redirect the flow of combustion gases through U-bend ducts, increasing residence time in the combustion areas, as well as reducing the unidimensional length of the device. The refractory lining may be used to prevent the ducting from warping due to intense heat generated by the burner, and thereby reduce the probability of system failure.

In some embodiments, these ducts may include a first duct, a second duct, a third duct, and a fourth duct. The combustion chamber may be fluidly connected to an inlet of the first duct. The first duct may direct a fluid flow exiting the combustion chamber into an inlet of the second duct. This arrangement may result in the direction of the fluid flow in the second duct being antiparallel to the direction of the fluid flow in the combustion chamber. The third duct, being fluidly connected to the second duct, may direct the fluid flow from an outlet of the second duct into an inlet of the fourth duct. This may result in the direction of the fluid flow in the fourth duct being antiparallel to the direction of the fluid flow in the second duct, and parallel to the direction of the fluid flow in the combustion chamber. Furthermore, at least the combustion chamber, the first duct, and the second duct may have a refractory lining.

In another embodiment, the refractory lining may be composed of one or more materials, including alumina, alumina oxide, silicon oxide, magnesium oxide, calcium oxide, fire clays, zirconia, silicon carbide, tungsten carbide, boron nitride, hafnium carbide, molybdenum disilicide, tantalum hafnium carbide, corundum, or plastic refractories. These materials may be utilized in the construction of the refractory lining of the combustion chamber, the first duct, and the second duct. The fourth duct may be designed to output the fluid flow to a dehydrator. The inlet of the combustion chamber may be connected to a burner. The third duct may be a box that has microporous insulation with a superalloy liner. This box may have a panel containing measurement instruments.

In yet another embodiment, the fourth duct may feature a microporous insulation with a superalloy liner. The compact thermal oxidizer may also feature a burner. The fan assembly may supply a flow of combustion air to this burner. The burner may intake the flow of combustion air and a flow of fuel and output a fluid flow of combustion reactants into the combustion chamber. In the combustion chamber, these combustion reactants may be combusted to form combustion products.

BRIEF DESCRIPTION OF THE DRAWINGS

The present invention is described in detail below with reference to the attached drawing figures, which are incorporated by reference herein and wherein.

DETAILED DESCRIPTION

Figure 1A:
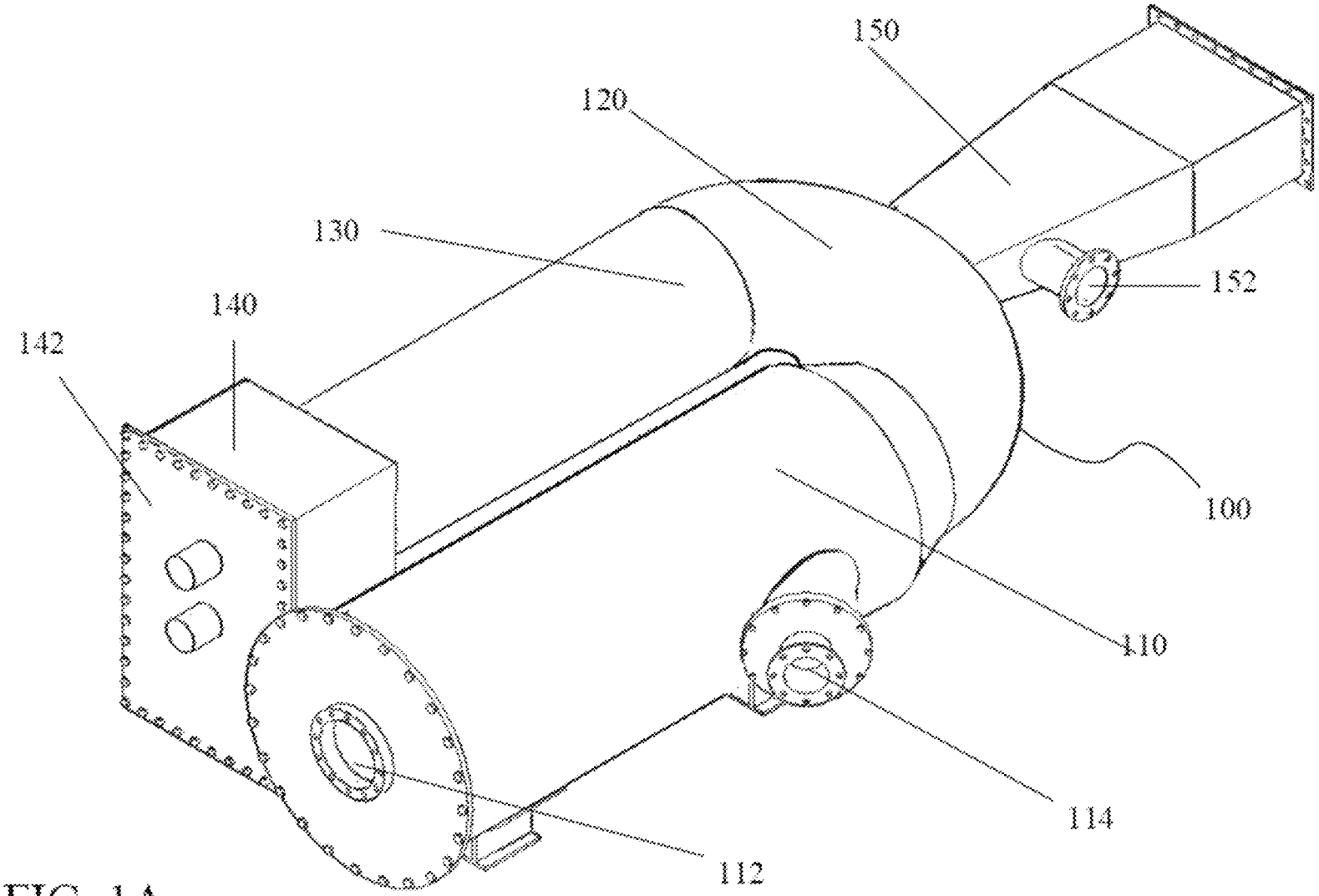
FIG. 1A illustrates a first perspective view of a compact thermal oxidizer, according to an example embodiment of the present disclosure.

Although the following text sets forth a detailed description of numerous different embodiments, it should be understood that the legal scope of the description is defined by the words of the claims set forth at the end of this disclosure. The detailed description is to be construed as exemplary only and does not describe every possible embodiment since describing every possible embodiment would be impractical, if not impossible. Numerous alternative embodiments could be implemented, using either current technology or technology developed after the filing date of this patent application, which would still fall within the scope of the claims.

It should also be understood that, unless a term is expressly defined in this patent using the sentence, there is no intent to limit the meaning of that term, either expressly or by implication, beyond its plain or ordinary meaning, and such term should not be interpreted to be limited in scope based on any statement made in any section of this patent application (other than the language of the claims). To the extent that any term recited in the claims at the end of this patent application is referred to in this patent application in a manner consistent with a single meaning, that is done for sake of clarity only so as to not confuse the reader, and it is not intended that such claim term by limited, by implication or otherwise, to that single meaning. Finally, unless a claim element is defined by reciting the word "means" and a function without the recital of any structure, it is not intended that the scope of any claim element be interpreted based on the application of 35 U.S.C. § 112, sixth paragraph.

Consistent with embodiments of the present disclosure, a compact thermal oxidizer may comprise a combustion chamber and a plurality of ducts. These ducts may include a first duct, a second duct, a third duct, and a fourth duct. The combustion chamber may be fluidly connected to an inlet of the first duct. This first duct may direct a fluid flow exiting the combustion chamber into an inlet of the second duct. This arrangement may allow the direction of the fluid flow in the second duct to be antiparallel to the direction of the fluid flow in the combustion chamber.

In another embodiment, the third duct, fluidly connected to the second duct, may direct the fluid flow from an outlet of the second duct into an inlet of the fourth duct. This configuration may enable the direction of the fluid flow in the fourth duct to be antiparallel to the direction of the fluid flow in the second duct and parallel to the direction of the fluid flow in the combustion chamber.

In still another embodiment, the combustion chamber, the first duct, and the second duct may be lined with a refractory material. This refractory lining may comprise one or more of alumina, alumina oxide, silicon oxide, magnesium oxide, calcium oxide, fire clays, zirconia, silicon carbide, tungsten carbide, boron nitride, hafnium carbide, molybdenum disilicide, tantalum hafnium carbide, corundum, and/or plastic refractories.

In another embodiment, the compact refractory lined thermal oxidizer may be configured such that combustion products are expelled to provide thermal energy to other systems, and/or dispose of vaporous waste products. In one example embodiment, the compact refractory lined thermal oxidizer may have a function in the manufacture of flu vaccines. Thermal energy from combustion products may be used to dehydrate vaccine components at scale. Vapors containing the flu virus, which may be expelled during the dehydration process, may be introduced to the combustion chamber where they are subsequently incinerated. Those skilled in the art will appreciate that while the embodiments of this disclosure may pertain to the manufacture of flu vaccines, the device may be employed in numerous other manners.

In some embodiments, the present disclosure provides a refractory lined thermal oxidizer having a compact configuration. By introducing U-bend ducts and repeatedly inverting or reversing the direction of flow of combustion gases, the thermal oxidizer can be shortened in a single dimension, while maintaining the overall path length of the combustion flow.

By introducing the U-bends in the ducting, the unidimensional length of the primary duct may be dramatically shortened relative to conventional designs, decreasing use of space in a first dimension. Since the ducting is redirected into two dimensions, e.g. routing the ducts under or alongside one another, the total footprint of the device can be reduced.

One concern in any industrial application of combustion may be combustion efficiency, a metric maximized by complete combustion of all injected fuel. In some embodiments, the compact design may provide an advantage in this respect as well. U-bends may increase the turbulence of fluid flow through the ducts, which reduces the velocity of the fluid flow and contributes to mixing of the fuel and air in the flow. The reduced flow velocity may increase the time the combustion reactants spend in the combustion areas, and the increased turbulence may increase mixing of the combustion reactants, helping to ensure that the conditions for combustion are met for the entire volume of fuel.

Introduction of U-bend ducts may expose certain walls of the ductwork to direct streams of combustion components with great quantities thermal energy. In a traditional configuration, these ducts would simply flank the high temperature flow of combustion components and suffer less direct exposure to the intense thermal flows. In the compact configuration, however, certain ducts or portions thereof may be heated by the combustion flows. Such heat has potential to cause structural failure, such as deformation, warping or melting of the ducts to a point that the function of the device is no longer safe or practical. In order to help avoid this structural failure, various embodiments of the present disclosure may introduce a configuration that includes a refractory lining into the ducts. For example, the lining may be introduced in the entirety of the ducts, or in certain portions of the ducts (e.g., those portions most directly exposed to the high temperature flows). The refractory lining may help to prevent the ductwork from directly contacting the high temperature flows, thereby reducing or preventing structural failure of the ducts.

FIG. 1A illustrates a compact refractory lined thermal oxidizer 100, which includes a combustion chamber 110, a U-bend return duct 120, a mixing duct 130, a box 140, and an exhaust duct 150.

In some embodiments, the combustion chamber 110 may include a first inlet port or duct 112, which is configured to receive a burner (not shown), and second inlet port or duct 114, via which vapors can be introduced to the combustion chamber. In some embodiments, the vapors introduced via the second inlet port 114 may be incinerated. Those skilled in the art will recognize that the second inlet port 114 may be used to communicate other vapors and fluids into the combustion chamber in place of or in addition to those vapors to be incinerated. The combustion chamber 110 may facilitate a combustion reaction, and the vapors contained therein may undergo a combustion reaction.

In some embodiments, the combustion chamber 110 may include one or more outlets to provide fluid communication from the combustion chamber into the U-bend return duct 120. The U-bend return duct 120 may have a generally U-shaped bend configured to alter a direction of fluid flow by approximately 180 degrees, such that a direction of fluid flow entering the U-bend return duct is approximately antiparallel to a direction of fluid flow exiting the U-bend return duct. The U-bend return duct 120 may include one or more outlets to provide fluid communication from the return duct into the mixing duct 130. In the mixing duct 130, remaining combustion reactants are combusted, and the combustion products homogenize. In the present disclosure, combustion products may include, for example, any gases and combusted or uncombusted fuels expelled from the burner, any vapors or fluids injected via the first and/or second inlet ports 112, 114, and resultant products of any combustion thereof.

Figure 1B:
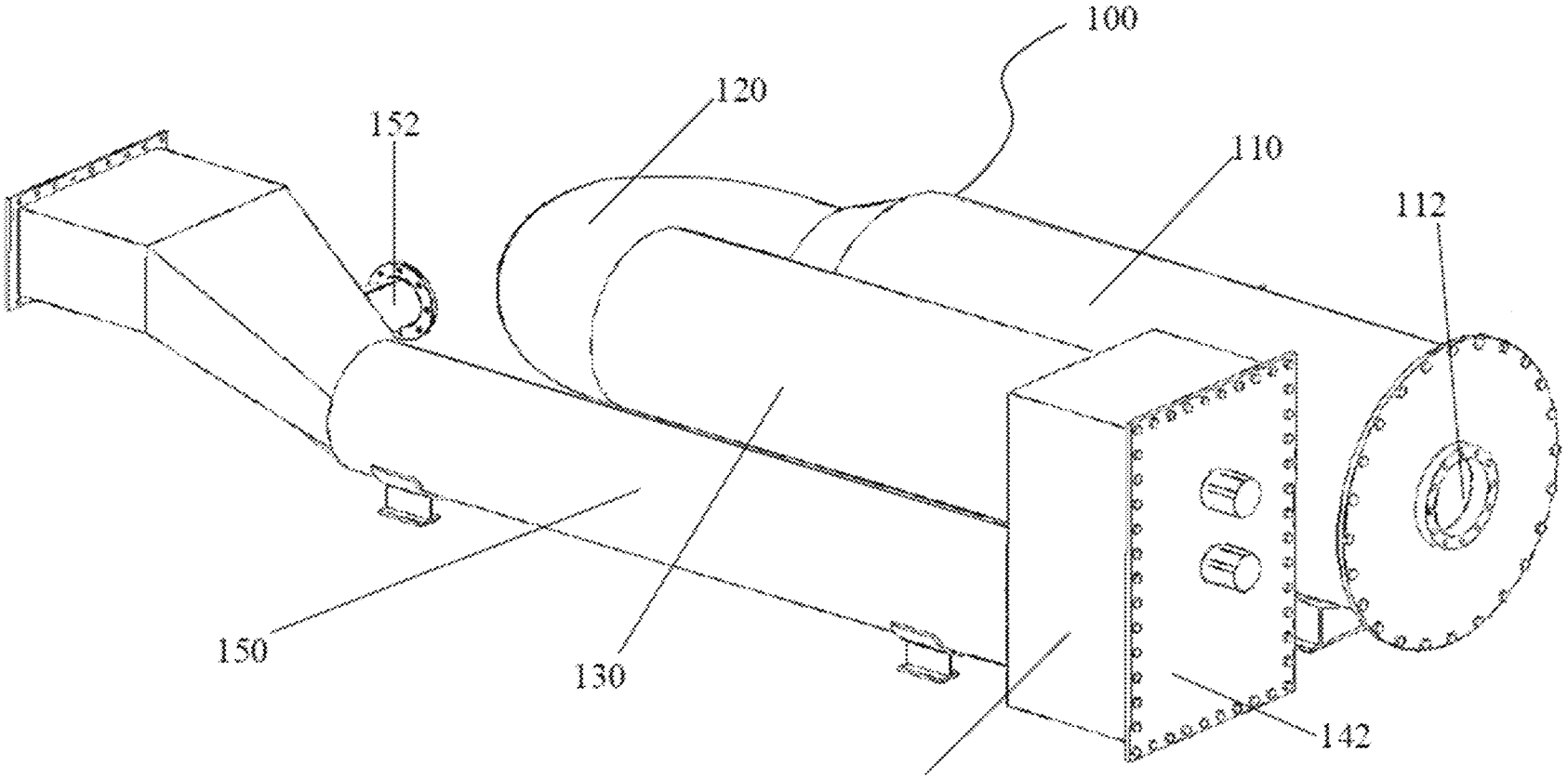
FIG. 1B illustrates a second perspective view of the compact thermal oxidizer, according to an example embodiment of the present disclosure.

In an embodiment, the mixing duct 130 may include one or more outlets to provide fluid communication between the mixing duct and a second return duct, which in the present embodiment is a box 140. The interior of the box 140 may include microporous insulation with a superalloy liner. As best shown in FIGS. 1A and 1B, the box 140 may include an instrument panel 142, the instrumentation of which may vary between embodiments. As some examples, the instrument panel 142 may include, but is not limited to, thermocouples and/or flow measurement devices. According to some embodiments, the instrument panel 142 and/or the box 140 may be operable to provide access to the ducting of the compact thermal oxidizer 100 as is needed for maintenance.

In some embodiments, the box 140 diverts the flow of combustion gases by approximately 180 degrees. This diversion results in a flow that is substantially parallel (but in an opposite direction) to the flow exhausted by the burner in the combustion chamber 110. The box 140 may include one or more outlets to provide fluid communication between the box and exhaust duct 150. In the present embodiment, the exhaust duct 150 exhausts combustion products to a dehydrator (See FIG. 4), but those skilled in the art will recognize that in other embodiments the combustion products may be exhausted to other locations or devices as is necessary or desirable for the function of a given embodiment. The exhaust duct 150 may include a quench port 152, for emergency situations in which combustion is incomplete upon exiting the mixing duct 130 and is still occurring in the box 140 and/or the exhaust duct 150.

FIG. 1B illustrates an alternate perspective on the compact refractory lined thermal oxidizer 100 such that certain features are more easily viewed than in FIG. 1A.

Figure 2A:
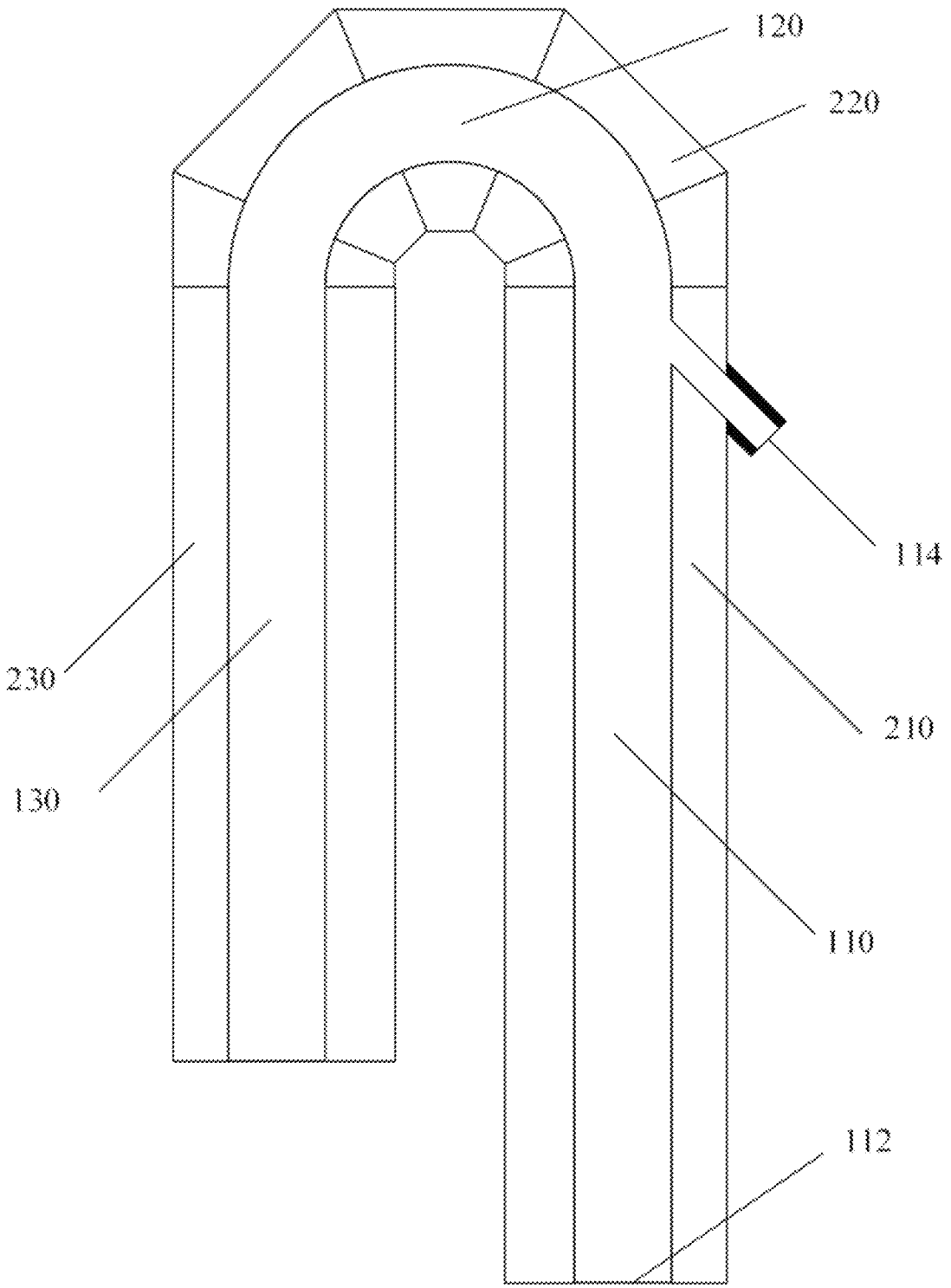
FIG. 2A illustrates a first cross sectional view of a portion of a first embodiment of a compact refractory lined thermal oxidizer 100 having an inlet duct in fluid communication with the first duct, according to example embodiments of the present disclosure.
Figure 2B:
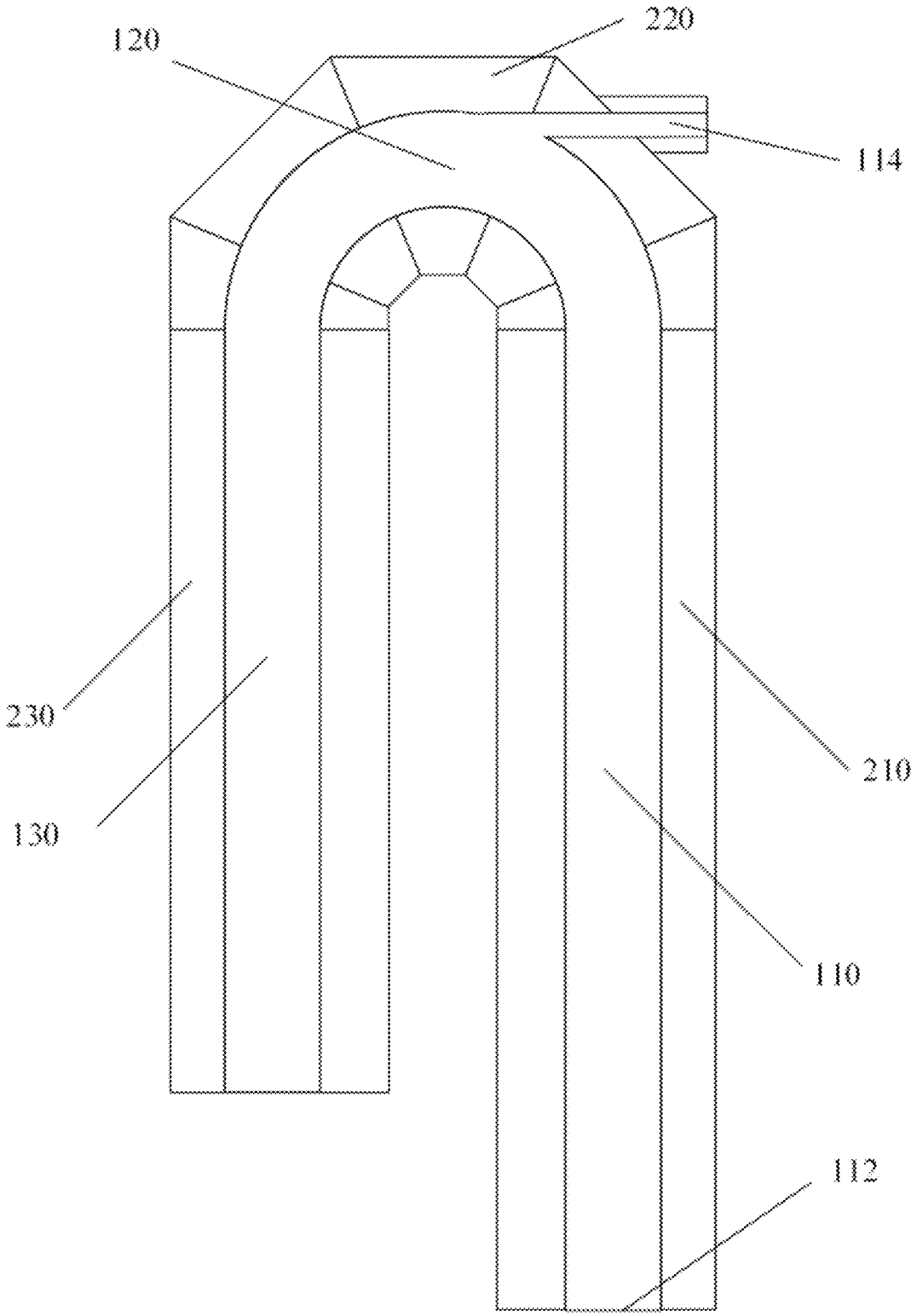
FIG. 2B illustrates a second cross-sectional view of a portion of a second embodiment of the compact refractory-lined thermal oxidizer 100 having an inlet duct in fluid communication with the U-bend joint, according to example embodiments of the present disclosure.

FIGS. 2A and 2B each illustrate a respective example of a cross sectional view of a portion of a compact, refractory lined thermal oxidizer 100, including the combustion chamber 110, the U-bend return duct 120, and the mixing duct 130 in which some additional features are detailed. As shown in FIGS. 2A and 2B, the combustion chamber 110 includes a refractory lining 210 that substantially coats interior surfaces of the combustion chamber, the U-bend return duct 120 includes a refractory lining 220 that substantially coats interior surfaces of the U-bend return duct, and mixing duct 130 includes a refractory lining 230 that substantially coats interior surfaces of the mixing duct. In embodiments, the refractory linings 210, 220, 230 may be disposed about all of the interior surfaces exposed to combustion products and accompanying thermal energy within the combustion chamber 110, the U-bend return duct 120, and the mixing duct 130, respectively. The refractory linings 210, 220, 230 serve as insulators to prevent distortion of the steel construction of the combustion chamber 110, the U-bend return duct 120, and the mixing duct 130. The refractory linings 210, 220, 230 may be formed from materials including, but are not limited to: alumina, alumina oxide, silicon oxide, magnesium oxide, calcium oxide, fire clays, zirconia, silicon carbide, tungsten carbide, boron nitride, hafnium carbide, molybdenum disilicide, tantalum hafnium carbide, corundum, plastic refractories, and/or combinations thereof. The refractory linings 21, 220, 230 may be sufficient to withstand temperatures up to 3000° F. without structural failure of the components lined by the refractory linings.

First inlet duct 112 and second inlet duct 114 are included in FIGS. 2A and 2B for reference. In FIG. 2A, the second inlet duct 114 is shown in a first configuration, inletting to the combustion chamber 110. In FIG. 2B, the second inlet duct 114 is shown in a second configuration inletting to the U-bend return duct 120.

Figure 3:
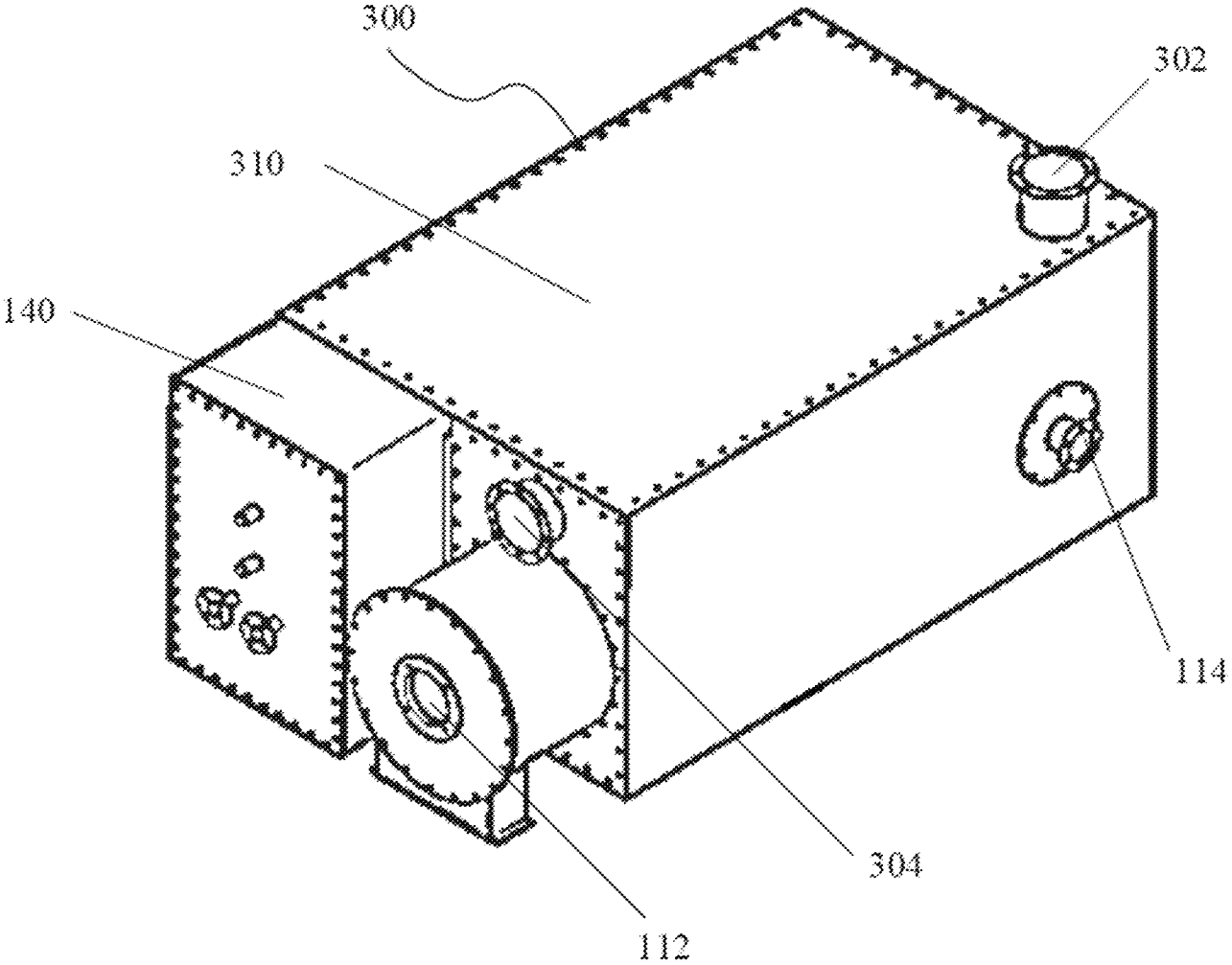
FIG. 3 illustrates a view of a compact thermal oxidizer, showing a preheater box and a maintenance box, according to example embodiments of the present disclosure.

FIG. 3 shows another embodiment of a compact refractory lined thermal oxidizer 300 wherein the ductwork is housed within and/or surrounded by a preheater box 310. As shown in FIG. 3, the preheater box 310 may substantially surround at least a portion of the compact thermal oxidizer. Combustion air enters the preheater box 310 via a third inlet port 302, where excess heat from the combustion chamber, and pursuant ducting (disposed within the preheater box and not viewable in FIG. 3) is transferred to the combustion air which then exits the preheater box via an outlet port 304, which is then used as intake air at the burner. The first inlet duct 112, the second inlet duct 114, and the box 140 are included in FIG. 3 for reference.

Figure 4:
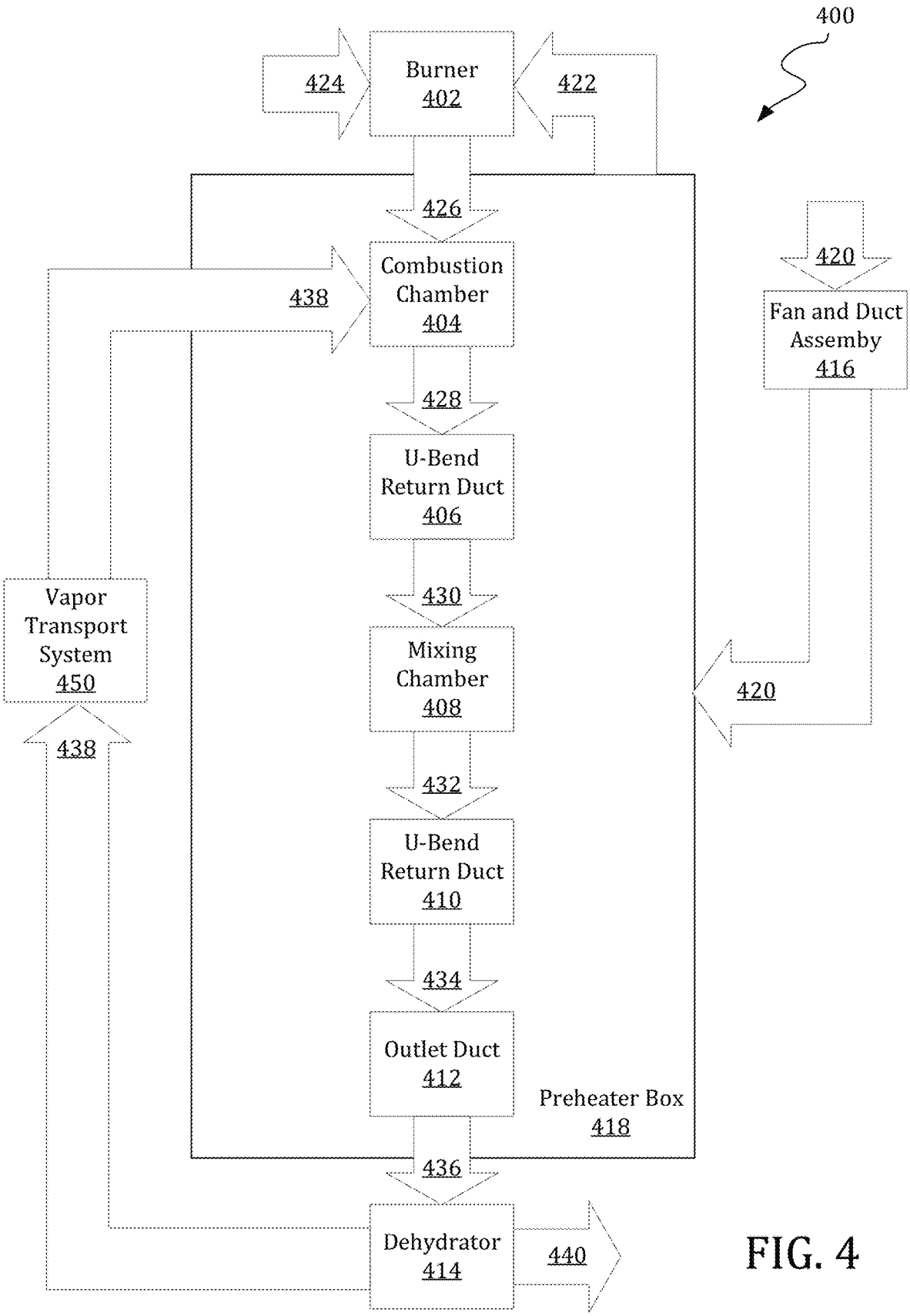
FIG. 4 illustrates a flowchart of a system including a compact refractory lined thermal oxidizer, a dehydrator, a burner, and fan assemblies, according to example embodiments of the present disclosure.

FIG. 4 illustrates a diagram of the flows through a system 400 including the compact refractory lined thermal oxidizer 300, burner, fan assembly, and dehydrator. Outside air 420 is pumped into the preheater box 418 via the fan assembly 416. As shown in FIG. 4, the fan assembly 416 may be disposed upstream of the preheater box 418, but configurations where the fan assembly 416 is downstream of the preheater box 418 are also contemplated. In the preheater box 418, the air is heated to become hot combustion air 422, which is then pumped into the burner 402 as an input. In embodiments, the outside air 420 is heated by heat that escapes the ducting within the preheater box. In the burner 402, the hot combustion air 422 is combined with an input of fuel 424 to produce a flow of combustion reactants 426 which is output from the burner and injected into the combustion chamber 404 and ignited.

The fuel used in the burner 402 may vary according to embodiments, and can include (but is not limited to), methane, natural gas, propane, butane, hydrogen gas, coal, other sources of combustible hydrocarbons, and/or combinations thereof.

In some embodiments, the use of preheated air for the hot combustion air 422 increases thermal efficiency of the thermal oxidizer, as it has a greater amount of available thermal energy prior to entering the burner 402, compared to outside air 420. In the burner 402, at least two conditions are requisite for combustion to occur; the presence of oxygen, and sufficient ambient heat energy to initiate the combustion reaction. The air supplied (e.g., the hot combustion air 422) provides the oxygen, but since ambient air (e.g., outside air 420, hot combustion air 422) does not have sufficient heat to drive combustion of its own accord, further combustion is reliant on the heat output of the combustion already taking place in the burner 402. Adding air to provide the oxygen reduces the overall temperature inside the combustion chamber 404, meaning that more heat from combustion must be used for further combustion. Thus preheating the air (e.g., by using hot combustion air 422 in place of outside air 420) reduces the burden on the heat from combustion to raise the temperature of the incoming air to sufficient heats to allow for combustion, resulting in a greater thermal efficiency of the system.

In an embodiment, a vapor 438 may be injected into the combustion chamber 404 simultaneously with the hot combustion air 422. According to some embodiments the vapor 438 may contain a viral load, such as flu virus that is a by-product of vaccine production. The vapor 438 may be injected into the combustion chamber 404 in order for the vapor and at least a portion of the contents thereof (e.g., the viral load) to be incinerated.

In some embodiments, a mixture of combusted products and uncombusted reactants 428 flows into a first U-bend return duct 406 where the combustion process continues and the flow 430 is redirected into a mixing chamber 408. In some embodiments, upon exiting the mixing chamber 408 combustion is substantially completed and the flow consists substantially entirely of combustion products 432. Alternatively, the flow 432 may contain combustion reactants in various stages of combustion. In the flow 432, the entire viral load of the injected vapor 438 is preferably neutralized, and enters a second U-bend return duct 410, which may take the form of a box that has microporous insulation with a superalloy liner.

In some embodiments, the flow 434 may be redirected into the outlet duct 412, which may contain microporous insulation with a superalloy liner. Exhaust gases 436, which retain significant thermal energy when compared to the surrounding environment, are directed into a dehydrator 414, where a thermal exchange occurs. The heat of the exhaust gases 436 may be used to power the dehydrator 414, and the cooled exhaust gas 440 is expelled from the system. The dehydrator 414, as a result of operation, expels a vapor 438, which is directed into a vapor transport system 450 that injects the vapor into the combustion chamber 404.

According to some embodiments, the dehydrator 414 processes flu viruses using cells from chicken eggs as a growth medium, and the vapor 438 expelled by the dehydrator contains a viral load. Upon injection of the vapor 438 into the combustion chamber 404, substantially the entire viral load may be neutralized by raising the temperature of the vapor in excess of 1500° F.

According to some embodiments, the outlet duct 412 can be fluidly connected to an external device, machine, or system that uses thermal energy to perform a function, such as a dehydrator 414.

According to some embodiments, the fan assembly 416 may include, but is not limited to, fans, ducts, pipes, tubes, filters, and/or pumps.

According to some embodiments, the third inlet port (e.g., inlet port 302) may be fluidly connected to ductwork and a fan assembly (e.g., fan assembly 416), operable to drive air into and/or out of the preheater box (e.g., preheater box 310, preheater box 418).

According to some embodiments, the outlet port may be fluidly connected to ductwork and the fan assembly 416, operable to pull air out of the preheater box 418.

According to some embodiments, the first inlet duct 112 may be configured to rigidly connect to a burner assembly (e.g., burner 402).

According to some embodiments, the cross section (taken on the plane perpendicular to the fluid flow) of the combustion chamber (e.g., combustion chamber 110, combustion chamber 404) may be cylindrical, square, rectangular, and/or any of a variety of shapes.

According to some embodiments, the cross section (taken on the plane perpendicular to the fluid flow) of the U-bend return duct (e.g., U-bend return duct 406, U-bend return duct 120) may be cylindrical, square, rectangular, and/or any of a variety of shapes.

According to some embodiments, the cross section (taken on the plane perpendicular to the fluid flow) of the mixing duct (e.g., mixing duct 130, mixing chamber 408) may be cylindrical, square, rectangular, and/or any of a variety of shapes.

According to some embodiments, the cross section (taken on the plane perpendicular to the fluid flow) of the exhaust duct (e.g., exhaust duct 150, outlet duct 412) may be cylindrical, square, rectangular, or any of a variety of shapes.

According to some embodiments, the cross sections (taken on the plane perpendicular to the fluid flow) of any of the ports may be cylindrical, square, rectangular, or any of a variety of shapes.

According to some embodiments, the second inlet port or duct 114 may be configured to house an injection lance to communicate vapors or fluids into the combustion chamber (e.g., combustion chamber 110, combustion chamber 404).

According to some embodiments, the box 140 may include, be formed as, and/or be replaced with a second U-bend return duct (e.g., the second U-bend return duct 410) that includes a refractory lining and/or has microporous insulation with a superalloy liner.

According to some embodiments, the exhaust duct (e.g., exhaust duct 150, outlet duct 412) may have a refractory lining or have microporous insulation with a superalloy liner.

According to some embodiments, the refractory lining materials may include, but are not limited to: alumina, alumina oxide, silicon oxide, magnesium oxide, calcium oxide, fire clays, zirconia, silicon carbide, tungsten carbide, boron nitride, hafnium carbide, molybdenum disilicide, tantalum hafnium carbide, corundum, plastic refractories, and/or combinations thereof. The refractory lining may be sufficient to withstand temperatures up to 3000° F. without structural failure of the lined components.

In some embodiments, ductwork may be configured to accommodate specific space requirements, such that there are more or fewer U-bend return ducts, 90° bend ducts, other types of bent ducts, and/or other configurations of straight ducts. While the present disclosure refers primarily to a configuration of three straight sections and two 180° turns in the ducting, other configurations are also contemplated.

According to some embodiments, the exhaust duct (e.g., exhaust duct 150, outlet duct 412) and the mixing chamber (e.g., mixing duct 130, mixing chamber 408) may be configured such that the mixing chamber provides external structural support to the exhaust duct.

According to some embodiments, the mixing duct (e.g., mixing duct 130, mixing chamber 408), U-bend return ducts (e.g., U-bend return duct 120, U-bend return duct 406, second U-bend return duct 410) and exhaust ducts (e.g., exhaust duct 150, outlet duct 412) may have variable diameters and aspect ratios to accommodate various pressure and velocity parameters.

According to some embodiments, the compact refractory lined thermal oxidizer 100, 300 may be used as a part of a system including a dehydrator 414, a burner 402, a fan and duct assembly 416, and/or a vapor transport system 450. The fan and duct assembly may supply combustion air to the burner, which drives combustion in the compact thermal oxidizer. The compact thermal oxidizer may output heated gasses to the dehydrator, which dehydrates a substance that releases a vapor, and the vapor is transported, via the vapor transport system, to be incinerated in the combustion chamber (e.g., combustion chamber 110, combustion chamber 404) of the oxidizer.

According to some embodiments, the vapor transport system 450 may be comprised of components which include, but are not limited to, ducts, pipes, tubes, pumps and fans.

According to some embodiments, air may be pumped through the preheater box (e.g., preheater box 310, preheater box 418) as a secondary measure to cool the components housed within the preheater box, after which the air is diverted away from the burner intake. This cooling measure can help preserve the integrity of the thermal oxidizer in the event of an overheating.

According to some embodiments, the preheater box (e.g., preheater box 310, preheater box 418) may contain a plurality of air shields or baffles external to the ducting designed to direct preheater air around the preheater box before exiting to the burner for more even preheating.

According to some embodiments, the second inlet port or duct 114 and the vapor transport system 450 may be configured to direct vapor into the combustion chamber (e.g., combustion chamber 110, combustion chamber 404) at various flowrates and angles of entry. The angle of entry and flowrate of the vapor can be tailored to induce a cooling effect on areas of the combustion chamber and/or the first U-bend return duct 406, in addition to and/or in place of the insulating effects of the refractory linings disposed therein.

According to some embodiments, the vapor transport system 450 and second inlet or duct 114 may be configured such that the second inlet injects to the first U-bend return duct 406 as opposed to the combustion chamber (e.g., combustion chamber 110, combustion chamber 404).

According to some embodiments, the ducting in some areas of the thermal oxidizer possesses microporous insulation and a superalloy liner. The microporous insulation is a high efficiency thermal insulator with a low thermal conductivity, rated to withstand high temperatures (e.g., temperatures up to 2000° F., 2100° F., 2200° F., 2300° F., 2400° F., 2500° F., etc.). The superalloy lining may provide protection to the insulation from the vapor that condenses after the system is shut down. The condensed vapor evaporates once the system is restarted.

Certain terms are used throughout the description and the claims to refer to particular features or components. As one skilled in the art will appreciate, different persons may refer to the same feature or component by different names. This document does not intend to distinguish between components or features that differ in name but not function.

According to some embodiments, the compact refractory lined thermal oxidizer may include a sight glass disposed on, for example, the ducting or combustion chamber. The sight glass may allow an operator to view the flames within the device.

Throughout the description and claims, the terms "duct" and "ducting" are used to describe infrastructure capable of directing and transporting fluid flows. However, the present disclosure contemplates embodiments and interpretations wherein other forms of infrastructure capable of performing an identical function are employed in place of or in addition to the ducting. The additional infrastructure may include (but is not limited to) pipes, channels tubes, and the like, or combinations thereof.

Throughout the description and claims, the term "combustion products" is used. In a purely academic context, "combustion products" would pertain to the gases released by the process of combustion. However, the present disclosure takes a broader practical interpretation, wherein "combustion products" includes any uncombusted fuels, ash, gasses, vapors added to the flow, and other incidental components contained within the flow traversing the compact refractory lined thermal oxidizer, in addition to the components of the traditional academic interpretation described above.

Throughout the description and claims, the term "fluid flow" is used. In the present disclosure, "fluid flow" is taken to mean a flow of fluid, either in liquid form, gaseous form, or a combination thereof. A fluid flow may include any solid particulate matter contained within the liquid or gaseous flow, including but not limited to ash, viral matter and/or other incidental solids, as a result of the operation of the compact refractory lined thermal oxidizer.

As used herein, "about," "approximately" and "substantially" are understood to refer to numbers in a range of the referenced number. For example, the range may be −10% to +10% of the referenced number, preferably −5% to +5% of the referenced number, more preferably −1% to +1% of the referenced number, most preferably −0.1% to +0.1% of the referenced number. While the ranges disclosed herein are indicated to be symmetric (e.g., with the referenced number at the center of the range), those of skill in the art will recognize that the range need not be symmetric.

Furthermore, all numerical ranges herein should be understood to include all integers, whole numbers, or fractions, within the range. Moreover, these numerical ranges should be construed as providing support for a claim directed to any number or subset of numbers in that range. For example, a disclosure of from 1 to 10 should be construed as supporting a range of from 1 to 8, from 3 to 7, from 1 to 9, from 3.6 to 4.6, from 3.5 to 9.9, and so forth.

As used in the present disclosure, a phrase referring to "at least one of" a list of items refers to any set of those items, including sets with a single member, and every potential combination thereof. For example, when referencing either "at least one of A, B, or C" or "at least one of A, B, and C", which are intended to be interpreted in the same way, the phrase is intended to cover the sets of: A, B, C, A-B, A-C, B-C, and A-B-C, where the sets may include one or multiple instances of a given member (e.g., A-A, A-A-A, A-A-B, A-A-B-B-C-C-C, etc.) and any ordering thereof. For avoidance of doubt, the phrase "at least one of A, B, and C" shall not be interpreted to mean "at least one of A, at least one of B, and at least one of C".

As used in the present disclosure, the term "determining" encompasses a variety of actions that may include calculating, computing, processing, deriving, investigating, looking up (e.g., via a table, database, or other data structure), ascertaining, receiving (e.g., receiving information), accessing (e.g., accessing data in a memory), retrieving, resolving, selecting, choosing, establishing, and the like.

Without further elaboration, it is believed that one skilled in the art can use the preceding description to make and/or use the claimed inventions to their fullest extent. The examples and aspects disclosed herein are to be construed as merely illustrative and not a limitation of the scope of the present disclosure in any way. It will be apparent to those having skill in the art that changes may be made to the details of the above-described examples without departing from the underlying principles discussed. In other words, various modifications and improvements of the examples specifically disclosed in the description above are within the scope of the appended claims. For instance, any suitable combination of features of the various examples described is contemplated.

Within the claims, reference to an element in the singular is not intended to mean "one and only one" unless specifically stated as such, but rather as "one or more" or "at least one". Unless specifically stated otherwise, the term "some" refers to one or more. No claim element is to be construed under the provision of 35 U.S.C. § 112 (f) unless the element is expressly recited using the phrase "means for" or "step for". All structural and functional equivalents to the elements of the various embodiments described in the present disclosure that are known or come later to be known to those of ordinary skill in the relevant art are expressly incorporated herein by reference and are intended to be encompassed by the claims. Moreover, nothing disclosed in the present disclosure is intended to be dedicated to the public regardless of whether such disclosure is explicitly recited in the claim.

Many different arrangements of the various components depicted, as well as components not shown, are possible without departing from the spirit and scope of the present invention. Embodiments of the present disclosure have been described with the intent to be illustrative rather than restrictive. Alternative embodiments will become apparent to those skilled in the art that do not depart from its scope. A skilled artisan may develop alternative means of implementing the aforementioned improvements without departing from the scope of the present disclosure.

It will be understood that certain features and subcombinations are of utility and may be employed without reference to other features and subcombinations and are contemplated within the scope of the claims. Not all steps listed in the various figures need to be carried out in the specific order described.

The invention claimed is:

1. A compact thermal oxidizer, comprising:

a combustion chamber; and a plurality of ducts including a first duct, a second duct, a third duct, and a fourth duct, wherein:

the combustion chamber is in fluid communication with an inlet of the first duct and the first duct is in fluid communication with the second duct, such that the first duct is configured to direct a fluid flow exiting the combustion chamber into an inlet of the second duct, and a direction of fluid flow in the second duct is antiparallel to a direction of fluid flow in the combustion chamber, and the second duct is in fluid communication with an inlet of the third duct, such that the third duct is configured to direct the fluid flow exiting the second duct into an inlet of the fourth duct, and a direction of the fluid flow in the fourth duct is antiparallel to the direction of fluid flow in the second duct and parallel to the direction of fluid flow in the combustion chamber, and wherein at least one of the third duct and the fourth duct comprises a microporous insulation with a superalloy liner; and a refractory lining disposed in interior surfaces of the combustion chamber, the first duct, and the second duct.

2. The compact thermal oxidizer of claim 1, wherein the refractory lining comprises one or more of: alumina, alumina oxide, silicon oxide, magnesium oxide, calcium oxide, fire clays, zirconia, silicon carbide, tungsten carbide, boron nitride, hafnium carbide, molybdenum disilicide, tantalum hafnium carbide, corundum, or plastic refractories.

3. The compact thermal oxidizer of claim 1, further comprising a dehydrator, wherein the fourth duct is in fluid communication with the dehydrator and configured to output the fluid flow to the dehydrator.

4. The compact thermal oxidizer of claim 1, wherein the combustion chamber comprises an inlet, and wherein the combustion chamber inlet is connected to a burner.

5. The compact thermal oxidizer of claim 1, wherein the third duct comprises a box containing the microporous insulation with the superalloy liner.

6. The compact thermal oxidizer of claim 1, wherein the fourth duct contains the microporous insulation with the superalloy liner.

7. The compact thermal oxidizer of claim 4, further comprising a preheater box configured to substantially surround the combustion chamber, the first duct, and the second duct, the preheated box comprising a fan assembly configured to pump air through the preheater box and into an air intake of the burner.

8. A system comprising;

a dehydrator configured to receive an input of thermal energy, and to output a vapor as a product of operation;

a burner configured to receive, as inputs, a flow of combustion air and a flow of fuel, and to produce, as an output, a fluid flow comprising combustion reactants;

a compact thermal oxidizer, comprising:

a combustion chamber in fluid communication with the burner;

a plurality of ducts, including a first duct, a second duct, a third duct and a fourth duct, wherein:

the combustion chamber is configured to receive the fluid flow of combustion reactants and to facilitate combustion of the combustion reactants to form combustion products, the first duct has an inlet in fluid communication with an outlet of the combustion chamber, and is configured to direct flow of the combustion products exiting the combustion chamber into an inlet of the second duct, such that a direction of fluid flow of combustion products in the second duct is antiparallel to a direction of fluid flow of the combustion products in the combustion chamber, the third duct has an inlet in fluid communication with an outlet of the second duct, and is configured to direct the fluid flow of combustion products from the outlet of the second duct into an inlet of the fourth duct, such that a direction of fluid flow of combustion products in the fourth duct is antiparallel to the direction of fluid flow in the second duct and parallel to the direction of fluid flow in the combustion chamber, the fourth duct is configured to exhaust the fluid flow of combustion products into the dehydrator, wherein the fluid flow has a significant thermal energy relative to a surrounding environment, into a dehydrator, and at least one of the third duct and the fourth duct comprises a microporous insulation with a superalloy liner, and a refractory lining substantially coating interior surfaces of the combustion chamber, the first duct, and the second duct; and a vapor transport system in fluid communication with the dehydrator, the vapor transport system being configured to transport the vapor output by the dehydrator to the compact thermal oxidizer to undergo combustion with the combustion reactants in at least one of the combustion chamber, the first duct, and the second duct.

9. The system of claim 8, wherein the refractory lining comprises one or more of: alumina, alumina oxide, silicon oxide, magnesium oxide, calcium oxide, fire clays, zirconia, silicon carbide, tungsten carbide, boron nitride, hafnium carbide, molybdenum disilicide, tantalum hafnium carbide, corundum, or plastic refractories.

10. The system of claim 8, wherein the third duct comprises a box containing the microporous insulation with the superalloy liner.

11. The system of claim 8, wherein the fourth duct comprises the microporous insulation with the superalloy liner.

12. The system of claim 8, wherein the vapor comprises a viral load.

13. The system of claim 8, wherein the vapor transport system comprises one or more of a duct, a tube and a pipe, a fan, and a pump.

14. The system of claim 8, wherein the vapor transport system is configured to transport vapor directly to the first duct.

15. A compact thermal oxidizer, comprising:

a burner configured to intake a flow of combustion air and a flow of fuel, and output a fluid flow of combustion reactants;

a fan assembly configured to drive the flow of combustion air to the burner;

a combustion chamber configured to receive the fluid flow of combustion reactants from the burner and to facilitate combustion of the combustion reactants to form combustion products;

a plurality of ducts, including:

a first duct having an inlet in fluid communication with the combustion chamber and having a generally U-shaped bend, the first duct being configured to receive a fluid flow of the combustion product from the combustion chamber, a second duct having an inlet in fluid communication with an outlet of the first duct, the second duct being configured to receive the fluid flow from the first duct such that a direction of fluid flow in the second duct is antiparallel to a direction of fluid flow of the combustion products in the combustion chamber, a third duct having an inlet in fluid communication with the second duct and having a generally U-shaped bend, the third duct being configured to receive the fluid flow of the combustion product from the second duct, and a fourth duct; having an inlet in fluid communication with an outlet of the third duct, the fourth duct being configured to receive the fluid flow from the third duct such that a direction of fluid flow in the fourth duct is antiparallel to the direction of fluid flow in the second duct and parallel to the direction of fluid flow in the combustion chamber, wherein the fourth duct provides an exit from the compact thermal oxidizer for the fluid flow, wherein at least one of the third duct and the fourth duct comprises a microporous insulation with a superalloy liner;

a housing configured surround the combustion chamber and the plurality of ducts, the housing comprising a housing inlet port into which the flow of combustion air enters, and a housing outlet port out of which the flow of combustion air exits, and wherein, prior to intake of the flow of combustion air at the burner, the flow of combustion air within the housing is heated via waste heat escaping the plurality of ducts, and a refractory lining disposed on interior surfaces of the combustion chamber, the first duct, and the second duct.

16. The compact thermal oxidizer of claim 15, wherein the refractory lining comprises one or more of: alumina, alumina oxide, silicon oxide, magnesium oxide, calcium oxide, fire clays, zirconia, silicon carbide, tungsten carbide, boron nitride, hafnium carbide, molybdenum disilicide, tantalum hafnium carbide, corundum, or plastic refractories.

17. The compact thermal oxidizer of claim 15, wherein the fourth duct outputs the fluid flow to a dehydrator.

18. The compact thermal oxidizer of claim 15, wherein the inlet of the combustion chamber is connected to a burner.

19. The compact thermal oxidizer of claim 15, wherein the third duct comprises a box that contains the microporous insulation with the superalloy liner.

20. The compact thermal oxidizer of claim 15, wherein the fourth duct comprises the microporous insulation with the superalloy liner.

* * * * *